US010151191B2

(12) United States Patent
Viitaniemi et al.

(10) Patent No.: US 10,151,191 B2
(45) Date of Patent: Dec. 11, 2018

(54) APPARATUS, ROCK DRILLING RIG AND METHOD FOR ROCK DRILLING

(71) Applicant: SANDVIK MINING AND CONSTRUCTION OY, Tampere (FI)

(72) Inventors: Jarno Viitaniemi, Tampere (FI); Ilkka Lahdelma, Tampere (FI); Tommi Kiviniemi, Tampere (FI); Martti Leskinen, Tampere (FI); Miika Huikkola, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 155 days.

(21) Appl. No.: 15/265,008

(22) Filed: Sep. 14, 2016

(65) Prior Publication Data

US 2017/0074086 A1 Mar. 16, 2017

(30) Foreign Application Priority Data

Sep. 15, 2015 (EP) ..... 15185213

(51) Int. Cl.

| | |
|---|---|
| ***E21B 44/02*** | (2006.01) |
| ***E21B 41/00*** | (2006.01) |
| ***E21B 3/025*** | (2006.01) |
| ***E21B 7/02*** | (2006.01) |

(52) U.S. Cl.

CPC ..... *E21B 44/02* (2013.01); *E21B 3/025* (2013.01); *E21B 7/022* (2013.01); *E21B 7/025* (2013.01); *E21B 41/0021* (2013.01)

(58) Field of Classification Search

CPC ..... E21B 3/025; E21B 7/022; E21B 7/025
See application file for complete search history.

(56) References Cited

U.S. PATENT DOCUMENTS

| | | | | |
|---|---|---|---|---|
| 4,341,271 | A | 7/1982 | Antero | |
| 4,711,090 | A | 12/1987 | Hartiala et al. | |
| 6,357,537 | B1 | 3/2002 | Runquist et al. | |
| 6,401,835 | B1 * | 6/2002 | Scheid et al. | E21B 3/025 173/11 |
| 6,796,390 | B1 * | 9/2004 | Bakker | E21B 7/04 175/61 |
| 2007/0256863 | A1 * | 11/2007 | Hulick et al. | E21B 3/025 175/55 |
| 2011/0162891 | A1 | 7/2011 | Camp | |
| 2013/0048378 | A1 * | 2/2013 | Pirinen et al. | E21B 1/00 175/24 |

FOREIGN PATENT DOCUMENTS

| | | | |
|---|---|---|---|
| JP | S48025497 | U | 7/1973 |
| JP | S60159210 | A | 8/1985 |
| JP | H01303304 | A | 12/1989 |
| JP | 2001012180 | A | 1/2001 |
| WO | 01/21929 | A1 | 3/2001 |

* cited by examiner

*Primary Examiner* — Shane Bomar
(74) *Attorney, Agent, or Firm* — Corinne R. Gorski

(57) ABSTRACT

An apparatus, rock drilling rig and method for rock drilling includes a turning device for moving a drilling tool around longitudinal axis of the tool. The turning movement is controlled by an alternating turning system so that direction of turning movement is continuously reversed to first and second turning directions. The turning angle of the tool is restricted and a safety system (is configured to monitor the operation and to ensure that a predetermined turning angle is not exceeded.

15 Claims, 6 Drawing Sheets

APPARATUS, ROCK DRILLING RIG AND METHOD FOR ROCK DRILLING

RELATED APPLICATION DATA

This application claims priority under 35 U.S.C. § 119 to EP Patent Application No. 15185213.4, filed on Sep. 15, 2015, which the entirety thereof is incorporated herein by reference.

BACKGROUND

The invention relates to an apparatus for rock drilling. The apparatus includes a rock drilling machine and a drilling tool connectable to the rock drilling machine. The rock drilling machine has means for moving the drilling tool around its longitudinal axis during the drilling.

The invention further relates to a rock drilling rig and method for drilling. In rock drilling, drill holes are drilled to rock material or soil by means of rock drilling machines arranged to rock drilling rigs. The drill holes may be drilled in mines, quarries and construction work sites and the drill holes may be blast holes, reinforcing holes or drill holes having any other purpose. During the drilling the drilling machine rotates a drilling tool around its longitudinal axis. The rotating drilling tool and rotating machine parts of the rock drilling machine may cause entanglement and severe injuries for drillers.

Typically protection against rotating parts of the rock drilling unit is taken care by preventing access to the rotating parts during the operation, or to stop the rotation movement before a person enters a dangerous zone. The known measures are to prevent access or to stop movement before people enter danger zone. Fixed guards as well as other physical protecting devices, such as protection cages, which enclose dangerous rotating parts of the drilling unit, may provide proper protection but they also have some disadvantages. The protection cages and alike increase weight of the drilling unit, add costs and decrease visibility. Disadvantage of access control systems monitoring the dangerous drilling zone is that they do not provide sufficient reliability. Thus, the present solutions have some problems and they do not provide satisfactory solutions for protecting the drillers without hampering productivity of the drilling.

SUMMARY

An object of the invention is to provide a novel and improved apparatus, rock drilling rig and method for rock drilling.

According to a disclosed solution, the apparatus includes a rock drilling machine, which is provided with a turning device for moving the drilling tool around longitudinal axis of the drilling tool. The turning device is controlled by means of one or more alternating turning systems so that the turning device is configured to reverse direction of movement of the drilling tool repeatedly. Thus, the drilling tool has repeated-variable turning direction during the drilling. In other words, the alternating turning systems allows the drilling tool to move alternately in a first turning direction and correspondingly in a second turning direction, and further, the alternating turning system is configured to limit magnitudes of the first and second turning movements to be below one or more predetermined maximum limit values. Thereby, the disclosed apparatus generates only allowed predetermined turning movements of the drilling tool in the both turning directions.

Furthermore, the apparatus includes one or more separate safety systems for securing that magnitude of the realized turning movements of the drilling tool does not exceed the allowed predetermined maximum turning movements. The safety system may operate independently relative to the turning device.

An advantage of the disclosed solution is that it provides simple and inexpensive protection against rotating parts of the rock drilling machine and the drilling tool. Since there is no need for the physical protective covers, such as protective cages, no visibility obstacles exist. Further, the disclosed solution does not add weight of the drilling machine. It has been noted in practical tests that the use of the alternating turning movement of the drilling tool does not decrease productivity of the drilling compared to conventional rotating drilling. On the contrary, wearing of the drilling tool is more evenly distributed because of the alternating turning movement, and thanks to this, service life of the drilling tool may be longer compared to conventional drilling, wherein the drilling tool is rotated continuously in one direction. Further, the disclosed solution is secure, since the alternating tuning system, the realized alternating turning movement, or they both, may be under constant monitoring.

According to an embodiment, the disclosed system prevents rotation of the drilling tool in both moving directions. The allowed predetermined turning movement in both turning directions limits the turning movements so that the drilling tool does not execute several full revolutions during the normal drilling. Since the generated turning movement alternates repeatedly, an item possibly entangled during the first movement will be removed during the succeeding second movement without causing serious injuries.

According to an embodiment, the allowed predetermined turning movement in both turning directions is below 360, or preferably between 300-360°. Thereby, the drilling tool never performs one full revolution but is only turned in accordance with a predetermined angular movement. Since the drilling tool does not rotate even one single revolution, no danger of entanglement to rotating machine parts exists.

According to an embodiment, the alternating turning system is configured to control the turning device to reverse direction of movement repeatedly without generating one full revolution in a first turning direction and correspondingly in a second turning direction.

According to an embodiment, the disclosed apparatus is configured to generate symmetrical alternating turning movement for the drilling tool. The the generated turning movement has the same or substantially the same magnitude in a first turning direction and in a second turning direction. In other words, turning angles are equal in both movement directions. The symmetrical alternating turning movements and their magnitudes may be controlled by means of the alternating turning system.

According to an embodiment, the disclosed apparatus is configured to generate several turning cycles, each of the turning cycles comprising turning of limited turning angle in the first turning direction and second turning direction The turning angles in the turning cycle have the same magnitude in both directions. Thereby, net turning angle of each of the turning cycles is zero. During drilling several turning cycles are executed consecutively. The turning angles of the consecutive turning cycles may have different magnitudes, whereby angular position of the drilling tool around the longitudinal axis is continuously altered. This way, drilling efficiency may be increased since a drill bit at a distal end of the drilling tool may influence to new unbroken rock material after each turning cycle.

According to an embodiment, the disclosed apparatus is configured to generate asymmetrical alternating turning movement of the drilling tool. Then, the generated turning movements have differing magnitudes in a first turning direction and in a second turning direction. In other words, use of varying rotation angles is implemented. The asymmetrical alternating turning movements and the turning angles in both directions may be controlled by means of the alternating turning system, for example.

According to an embodiment, the at least one safety system is operationally independent and dominant relative to the at least one alternating turning system and the turning device.

According to an embodiment, the at least one safety system is physically separate from the at least one alternating turning system and the turning device.

According to an embodiment, the at least one safety system is configured to monitor operation of the rock drilling machine and is configured to secure in response to the monitoring that magnitude of the realized turning movements is always below the allowed predetermined turning movements.

According to an embodiment, the turning device is a motor, which is structurally capable to generate continuous rotation in the first and second directions. In this embodiment the turning device is a rotating device or a turning motor, which is structurally capable to generate rotation, whereby it differs from solutions, which have internal structures which are capable to generate only limited tuning motions and thereby itself provide security. Further, the transmission, such as gearing, may also be structurally capable to transmit continuous rotation. Then, the safety system is a separate system and is not part of the motor or the transmission.

According to an embodiment, the apparatus includes one or more safety systems configured to monitor that the turning movements of the drilling tool remain below the set maximum turning values. Further, the safety system is configured to instantly stop the turning movements in response to detected exceed of the set maximum turning values. In addition to, the safety system may monitor operational condition of the turning device and the alternating turning system, and may instantly terminate the operation in response to detected failure of operation of the monitored devices and systems. Thanks to the instant stoppage of the drilling tool and the terminated operation of the apparatus, dangerous abnormal situations may be effectively prevented. The instant stoppage may be executed terminating feed of operating power of the turning device, for example.

According to an embodiment, the safety system is operationally independent and dominant relative to the alternating turning system. The safety system may include one or more sensing devices and processing devices of its own whereby it is not dependent on the devices of the alternating turning system. Further, commands and actions made by the safety system may be prioritized relative to the control commands of the normal operating system.

According to an embodiment, the safety system monitors operation of the alternating turning system and stops operation of the turning device in response to detected deviation in the operation of the alternating turning system. This way, the safety system notifies if the alternating turning system fails and further, the safety system may prevent further operation of the turning device until the system is repaired.

According to an embodiment, the safety system is configured to terminate the turning movements of the drilling tool in order to prevent exceed of the predetermined maximum turning magnitude. The turning movement may be limited mechanically, for example. In case the alternating turning system fails, the safety system assures that the turning movement of the drilling tool remains as desired and no safety problems arise. The safety system may comprise one or more mechanical stoppers for preventing the drilling tool to turn more than is allowed. The mechanical stoppers may be arranged in connection with the turning device, the drilling tool or a shank. Alternatively, or in addition to, the mechanical stoppers may be located in connection with an auxiliary intermediate element, which may be placed between the shank and the drilling tool. Due to the one or more mechanical or physical stoppers, full revolution of the drilling tool may be securely prevented in case of failure of the basic control system of the turning device.

According to an embodiment, configuration of the turning device is designed to allow only a limited turning movement in the first and second turning directions. A power device of the turning device may generate driving force in one movement direction only a limited period of time and thereby cause the limited turning movement. Alternatively, or in addition to, the transmission system or elements between the power device and the drilling tool may transmit only movements with limited magnitude, for example. Since an internal structure of the turning device only allows generating non-continuous turning movement for the drilling tool, the turning device itself provides security for the drilling work. However, the safe operation of the apparatus is additionally secured by means of the safety system and its features disclosed in this patent application.

Further, the operation of the disclosed turning device may be controlled by the alternating turning system, whereby the alternating turning system may reverse the turning direction towards the second direction after the limited turning movement has been executed in the first direction. The alternating turning system may be configured to generate maximum limited tuning movements in both directions, or alternative, it may control the turning device to produce turning movements having desired magnitudes in both directions.

According to an embodiment, the turning device includes a gearing between a power device of the turning device and the drilling tool. The gearing may comprise one or more gear wheels or toothed surfaces provided with a limited operational area, wherein proper teeth for torque transmission exist on a first portion of a circumference of the gear wheel or corresponding gear element. The remaining second portion of the circumference of the gear wheel or the toothed surface is without suitable teeth and therefore serves as a non-operational area. Because of the operational and the non-operational areas, the disclosed transmission system with missing gear teeth is capable to transmit only limited turning movement from the turning device to the drilling tool. Thereby, the disclosed transmission system may secure, by utilizing physical means, that the transmission system does not in any situation transmit unlimited turning movement or rotation to the drilling tool. The allowable turning angle may be set by dimensioning the operational area of the gear wheel suitably. In normal situations the operation of the turning device is controlled by means of the alternating turning system, and the disclosed gearing arrangement only provides additional security.

In addition to the internal safety arrangement, other separate safety systems disclosed herein may also be utilized. The disclosed transmission system provided with gear wheels with missing teeth is inexpensive to manufacture, durable, requires no additional components, and it provides a reliable physical arrangement for preventing oversized turning movements.

According to an embodiment, the turning device of the apparatus is a pressure medium operated turning actuator, such as a hydraulic or pneumatic motor or cylinder. Operation of the turning device may be controlled by means of one or more control valves of the alternating turning system. The control valve controls pressures prevailing in pressure medium ports of the pressure fluid operated turning actuator so that the turning direction of the turning actuator is reversed in response to operation of the control valve.

The safety system of the apparatus may monitor operation of the control valve and may stop operation of the turning device in response to detected deviation in the operation of the alternating turning system.

The safety system may monitor the operation of the control valve by detecting that the control valve moves properly during the operation and changes its positions between designed control positions.

The safety system can include movement sensors, proximity sensors and corresponding detection devices for sensing the physical movement of the control valve. Then, in case the control valve is jammed in one control position, this abnormal situation can be detected immediately and the operation of the turning device may be stopped. Alternatively, or in addition to, the safety system may also monitor pressures affecting in pressure channels connected to pressure medium ports of the turning device and may determine proper work cycle of the control valve on the basis of the pressure data.

According to an embodiment, the apparatus is in accordance with the previous embodiment and further includes one or more electrical monitoring elements. Then, the electrical monitoring elements of the safety system may be arranged in connection with the control valve in order to monitor proper operation of the control valve of the alternating turning system. The electrical monitoring elements may generate sensing signals based on which the safety system may decide to continue or terminate the operation of the turning device. Electrical monitoring elements such as sensors, sensing devices, transducers and measuring devices are relatively inexpensive and easy to install.

According to an embodiment, the turning device of the apparatus is a pressure medium operated turning actuator, such as a hydraulic or pneumatic motor or cylinder. Operation of the turning device may be controlled by means of one or more control valves of the alternating turning control system. The control valve controls pressures prevailing in pressure medium ports of the pressure fluid operated turning actuator so that the turning direction of the turning actuator is reversed in response to operation of the control valve. The control valve has a control element provided with at least two operational positions, between which the control element is moved during the operation of the turning device; and the electrical monitoring element is a sensing device configured to monitor physical position of the control element.

According to an embodiment, the turning device of the apparatus is a pressure medium operated turning actuator, such as a hydraulic or pneumatic motor or cylinder. Operation of the turning device may be controlled by means of one or more control valves of the alternating turning control system. The control valve controls pressures prevailing in pressure medium ports of the pressure fluid operated turning actuator so that the turning direction of the turning actuator is reversed in response to operation of the control valve. The control valve is pressure controlled and has a control element provided with at least two operational positions, between which the control element is moved during the operation of the turning device by directing control pressure to at least one pressure port of the control valve; and the electrical monitoring element is a sensing device configured to monitor changes in pressure medium prevailing in the at least one pressure port of the control valve.

According to an embodiment, the turning device of the apparatus is a pressure medium operated turning actuator, such as a hydraulic or pneumatic motor or cylinder. Operation of the turning device may be controlled by means of one or more control valves of the alternating turning control system. The control valve controls pressures prevailing in pressure medium ports of the pressure fluid operated turning actuator so that the turning direction of the turning actuator is reversed in response to operation of the control valve. The control valve is electrically controlled and has a control element provided with at least two operational positions, between which the control element is moved during the operation of the turning device by directing electric current to at least one electric actuator of the control valve; and the electrical monitoring element is a sensing device configured to monitor changes in the electric current controlling the operation of the control valve.

According to an embodiment, the turning device of the rock drilling machine is a pressure medium operated motor. The motor may be hydraulically or pneumatically operated, for example.

According to an embodiment, the turning device of the rock drilling machine is a hydraulic motor, which is connected to a hydraulic circuit by means of pressure ducts. The alternating turning system includes at least one control valve for controlling pressure medium flow in the mentioned pressure ducts so that the desired continuously reversing turning movement is produced. The safety system includes at least one additional second hydraulic motor connected to the at least one mentioned pressure medium duct. The second hydraulic motor is series-connected with the hydraulic turning device whereby both hydraulic motors operate simultaneously. Further, magnitude of the realized turning movements of the additional second hydraulic motor are mechanically limited, whereby the additional second hydraulic motor is configured to prevent the turning device to exceed the allowed predetermined turning movements. In connection with the mechanical stoppers or limiting elements may be limit switches or sensing devices, which may communicate with a control device of the safety system. In this embodiment, the electrical sensing means, and finally the mechanically stoppers, prevent the drilling tool to rotate or exceed any other predetermined turning angle limit. Due to the additional series connected second motor, the mechanical stoppers and electrical sensing devices may be located external to a drilling unit, whereby there is more space for them and circumstances are more convenient.

According to an embodiment, the safety system of the apparatus includes at least one sensing device for detecting turning angle of the turning movement produced by the turning device and being transmitted or directed to the drilling tool. The safety system is further provided with at least one maximum turning angle limit defining the greatest allowable turning movement is the first turning direction and the second turning direction. One or more sensing devices or detectors may be arranged to monitor turning movements of the turning device and its components, a shank or the drilling tool. The detection may be executed directly or indirectly. The generated detection signal may be transmitted to the safety device, which may comprise processing means for calculating and determining the realized turning angle of the drilling the safety device may take into account transmission ratios of turning system of the rock drilling machine and may thereby calculate the turning angle of the drilling tool on the basis of any received detection signal relating to the turning movement of the system. Thus, the safety device determines the realized turning angle, compares the determined realized turning angle to the set maximum turning angle and stops the turning in response to detected exceed of the maximum turning angle limit. This embodiment offers an inexpensive and rather simple solution for further improving reliability of the apparatus to generate safe turning movements.

According to an embodiment, the realized generated turning movement of the apparatus is determined directly by sensing the realized turning movement of the drilling tool. Thereby, the safety system is provided with one or more sensing devices or detectors for detecting realized turning movement of the drilling tool. The sensing device may be arranged at proximity of the drilling tool and it may generate detection signals, which are transmitted to the safety system for further processing. The safety system determines or calculates magnitude of realized turning angle of the drilling tool on the basis of the received detection data and may compare the detected turning angle value to a set maximum turning angle limit. In case the safety system detects that the realized turning movement exceeds the maximum turning angle limit, then the system stops the turning. This way, magnitude of the realized turning movements of the drilling tool is always below the allowed predetermined turning movements.

According to an embodiment, the realized generated turning movement of the apparatus is determined directly by sensing the realized turning movement of the drilling tool and this data is utilized for further ensuring that the drilling tool is not turned more than is allowed. The safety system is provided with one or more sensing devices or detectors for detecting realized turning movements of the drilling tool. The sensing device may be arranged at proximity of the drilling tool, and the drilling tool is provided with at least one monitoring band arranged around the drilling tool. The monitoring band may have several markers, tags or detectors, which may be detected by means of the sensing device arranged close to the monitoring band. The several markers of the monitoring band may be positioned so that they provide a sensing area covering only partially a total circumference of the monitoring band surrounding the tool. Thereby, the rest of the circumference left without any markers provides a non-sensing area for the monitoring band.

The sensing device is located at the sensing area whereby it detects the markers when they move together with the drilling tool the alternating predetermined angular turning movement. The sensing area of the monitoring band is dimensioned in accordance with the allowed turning angle. In case the turning of the drilling tool exceeds the allowed turning angle, then the non-sensing area with no markers becomes at the sensing device and then no detection signal is generated. In other words, exceeding of the allowed turning angle terminates generation of detection signals, and this is interpreted to mean malfunction of the apparatus. Information of the missing detection signal is transmitted to the safety system, which may stop the turning immediately.

Further, the safety system prevents the operation of the turning device if the monitoring band is removed, or if the markers or the sensing device are failed, since also in these cases no proper signals are generated and received by the safety system. This way, any abuse by operators is prevented and it is not possible to take off the safety system and disable the monitoring.

The markers may be detected remotely by means of inductive sensing device, or alternatively, the sensing may be based on magnetism, for example. One more possibility is that the markers are tags, which may be read and detected by utilizing a reader the operation of which is based on radio frequency identification. The monitoring band or strip may be made of plastic material and the markers may be embedded to the plastic material, or fastened to the surface of the band. Further, the sensing device may be mounted to a dedicated support element, or it may be connected to any structure locating around the drilling tool. In a further additional embodiment, the monitoring band may be arranged around a shank, which is moving together with the drilling tool. Then the same operating principles as when monitoring the drilling tool may be utilized.

According to an embodiment, the realized generated turning movement of the apparatus is determined directly by sensing the realized turning movement of the drilling tool and this data is utilized for further ensuring that the drilling tool is not turned more than is allowed. The embodiment is substantially similar to the one disclosed in the previous embodiment, but differs in that, instead of the disclosed monitoring band the drilling tool itself is provided with markers, which are detectable by means of the sensing device. Thus, in a first additional embodiment several markers or detectors are fastened directly on an outer surface of the drilling tool, whereby they can be sensed by means of the sensing device arranged close to the drilling tool. The markers may be mounted to the drilling tool by glue fastening, for example. In a second additional embodiment an outer surface of the drilling tool is provided with several marking grooves, protrusions or any other surface property or topographical feature detectable by means of the sensing device. Let it be mentioned, that the disclosed features may be utilized also when monitoring realized turning of a shank, by means of which the drilling tool is connected to the turning device.

According to an embodiment, an outer surface of a cross section of the drilling tool is angular. The cross section of the drilling tool may be hexagonal, for example. Then, an outer surface of the drilling tool includes edges, which may be detected by means of the sensing device of the safety system when the drilling tool is turned. The sensing device generates detection signals based on which the safety system may calculate turning angle of the drilling tool. If the monitoring detects that realized turning angle is greater than the predetermined allowed turning angle the safety system stops the turning movement.

According to an embodiment, the rock drilling machine includes a shank for connecting the drilling tool, and the turning device is configured to turn the drilling tool by means of the shank. The safety system is configured to monitor realized turning movement of the shank by means of one or more sensing devices. The shank and the drilling tool have the same realized turning movement, of course. The safety system determines magnitude of realized turning angle of the drilling tool on the basis of the detection data of the shank.

The safety system is provided with at least one maximum turning angle limit and when the safety system detects exceed of the maximum angle limit the operation of the turning device is stopped. Alternatively, the shank may be provided with several markers or tags defining a limited sensing area around a circumference of the shank.

As discussed above in previous embodiment(s), the markers or tags are determined by the sensing device or reader and when the turning movement is in accordance with the limited turning angle then proper signal are generated. When the turning angle is greater than the allowed turning angle, the shank turns so that no markers or tags are present at the sensing device and no monitoring signal is generated, wherefore the safety system stops the turning movement. Similarly, if the markers or tags are lost or failed, no proper monitoring signal is generated and the apparatus is stopped.

According to an embodiment, the safety system includes one or more contact-free sensing devices, sensors, readers or measuring devices mounted at proximity to the drilling tool or shank and configured to determine realized turning movement generated by the turning device and the alternating turning system controlling the turning device. The sensing device in connection with the drilling tool or shank may be an inductive sensor, for example. Alternatively, or in addition to, the operation of sensing device may be based on magnetism or radio frequency identification.

According to an embodiment, the magnitude of the realized turning angles of the drilling tool is determined by sensing movements of one or more turning machine elements of the turning device or the drilling machine. Then, the safety system may includes one or more sensing devices mounted to the rock drilling machine for detecting realized turning movement of the turning device.

The safety system is provided with needed calculating means for determining turning angles of the drilling tool on the basis of turning movement of one or more machine elements of the rotating device or a gear system.

Further, the safety system is provided with at least one maximum turning angle_limit, and the safety system may compare the calculated turning angle of the drilling tool to the turning angle limit and stops the operation of the turning device in response to exceed of the maximum turning angle limit. This way, the magnitude of the realized turning movement of the drilling tool remains always below the allowed predetermined turning movements. The sensing device arranged in connection with the rock drilling machine may be a contact-free sensor or measuring device mounted at proximity to the machine element of the rock drilling machine. The sensing device may be an inductive sensor, for example. Alternatively, or in addition to, the operation of sensing device may be based on magnetism. This embodiment may be utilized in situations where it is difficult to mount any indicators or markers to the drilling tool or shank.

According to an embodiment, the turning device of the rock drilling machine is a pressure fluid operated motor connected to a pressure fluid circuit by means of pressure ducts. Pressurized fluid is fed in batches to the motor, whereby the motor may, under influence of the dosed pressure fluid batches, only produce limited turning movements in both turning directions. The motor may be a hydraulic motor. The alternating turning system controlling the operation of the turning device may comprise one or more control valves. Further, the safety system may comprise one or more dosing cylinder mechanisms connected to the pressure duct of the motor. The control valve of the alternating turning system may control reciprocating motion of the dosing cylinder mechanism. Then, each stroke of the dosing cylinder mechanism may dose limited volume of pressurized fluid to the motor, whereby the dosed batches of pressurized fluid generate limited turning movements for the motor. The maximum turning movement generated by the motor may be adjusted by affecting to the volume of the dosed fluid batch. In an alternative solution, the reciprocating dosing cylinder may be substituted with another dosing mechanism, such as with a turning or rotating dosing element or space.

According to an embodiment, the turning device of the rock drilling machine is a pressure medium operated turning actuator connected to a pressure medium system by means of pressure medium lines. The turning actuator is operated by varying properties of pressurized fluid in one or more pressure chambers of the turning actuator. The properties of the pressurized fluid may be controlled by means of an alternating turning system. The pressurized fluid may be gas or hydraulic oil, for example.

The safety system of the apparatus may have one or more sensing devices configured to sense properties of pressure medium affecting in at least one pressure medium line connected to the pressure medium operated turning actuator. Alternatively, the one or more sensing devices may be arranged in connection to pressure ports or chambers of the turning device for determining the properties of the pressure medium. The sensing data is gathered by the safety system, which is configured to monitor the operation of the alternating turning system by means of the received sensing data. The sensing data may typically be pressure or flow rate data.

According to an embodiment, the turning device of the rock drilling machine is a pressure medium operated turning actuator connected to a pressure medium system, and the safety system of the apparatus is configured to receive sensing data relating to properties of pressure medium affecting the operation of the turning device.

The safety system may include one or more flow sensing devices arranged to detect pressure medium flows conveyed to the turning actuator. The safety system is configured to monitor the operation of the alternating turning system by means of the sensed flow data. Magnitude of the realized turning movement may be calculated on the basis of the sensed flow data when properties and dimensions of the turning device, such as volumes of the pressure chambers, are known. Alternatively, the safety system may be provided with limit values for the flow rate and may compare the sensed flow rate values to the set limit values when monitoring operational condition of the turning device.

According to an embodiment, the turning device of the rock drilling machine is a pressure medium operated turning actuator connected to a pressure medium system, and the safety system includes one or more flow sensing devices arranged to detect pressure medium flows conveyed to the turning actuator. The safety system is configured to calculate magnitude of turning angle of the drilling tool based on the flow data.

According to an embodiment, the turning device of the rock drilling machine is a pressure medium operated turning actuator connected to a pressure medium system, and the safety system includes one or more flow sensing devices arranged to detect pressure medium flows conveyed to the turning actuator. The safety system is configured to monitor changes in the flow and determines operational condition of the alternating turning system based on the changes in the flow. Since the pressure medium operated turning device executes continuous reversing turning movement, pressure flows vary in pressure lines or ports connected to turning device, and these changes in the flow data may be monitored in order to determine that proper reversing turning movements are executed and that no turning angles greater than set maximum values exist. The monitored change in the flow may be direction of the flow. The pressure medium operated turning actuator includes one or more pressure chambers each of them being provided with at least one pressure medium port and line. Direction of the pressure flow in the pressure line or port may be sensed, and on the basis of the sensed data proper reversing turning movement of the turning actuator may be detected. Alternatively, or in addition to, the monitored change in the flow may be duration of the flow.

According to an embodiment, the turning device of the rock drilling machine is a pressure medium operated turning actuator connected to a pressure medium system, and the safety system of the apparatus is configured to receive sensing data relating to properties of pressure medium affecting the operation of the turning device. The safety system may have one or more pressure sensing devices arranged to detect pressure in at least one pressure medium line of the turning actuator. Alternatively, the pressure sensing device may be arranged in connection to one or more pressure ports or chambers of the turning device.

The safety system is configured to monitor the operation of the alternating turning system by means of the sensed pressure data. Since the turning device executes reversing turning movement, pressure fluctuates in the pressure lines, ports and working pressure chambers of the turning device, and this feature may be utilized to monitor proper operational condition of the alternating turning system and the turning device.

According to an embodiment, the turning device of the rock drilling machine is a pressure medium operated turning actuator connected to a pressure medium system, and the safety system of the apparatus is configured to receive sensed pressure data from one or more pressure sensors or pressure measuring devices. Operation of the turning device is controlled by means of an alternating turning system, which directs pressure medium to pressure ports of the turning device in order to execute reversing turning movements. By measuring prevailing pressures affecting to the turning device operational condition of the alternating turning system may be detected.

Alternatively, the pressure sensing device is a pressure switch, which is configured to generate indication for the safety system when pressure in the pressure medium line exceeds a limit value. The pressure switch may be electrically operated and may generate an electric detection signal. Based on the received detection signal the safety system may determine durations of periods of time when pressure medium is fed to the working pressure chambers of the turning device for producing the reversing turning movements. The safety system may calculate the realized turning movements on the basis of the detected data or it may compare the detection data to a reference data determining maximum duration for the feeding of the pressure medium.

According to an embodiment, the turning motion of the drilling tool is monitored by means of a special switch which is located at proximity of a turning drilling tool or shank, and is connected to the drilling tool or a shank by means of a bendable wire or strip. The connecting wire has a predetermined length, which is dimensioned so that the desired limited turning movement is allowed without causing the switch to be triggered. As the drilling tool and the shank are turned, the bendable wire tightens and causes force effect for the switch. Exceed of the limited turning movements are arranged to cause the switch to be triggered and the operation of the turning device to be stopped. The switch may be an emergency stop. In connection with the switch may be a yo-yo-type element comprising a rotatable reel for the bendable wire or strip. The rotation of the reel may cause a force effect for the emergency switch and may thereby cause stoppage of the turning device when a turning movement exceeding a predetermined limit is detected.

According to an embodiment, the turning motion of the drilling tool is monitored by means of one or more physical stoppage elements protruding from an outer surface of a drilling tool or shank being turned by means of a turning device. At proximity and parallel to of the drilling tool or shank is located one or more safety wires or corresponding longitudinal elements, which are set at reach of the protruding stoppage element. Mutual positions of the one or more stoppage elements and the one or more safety wires are arranged in accordance with the allowed maximum turning angle of apparatus. The safety wire may be connected to an emergency switch for providing instant stoppage in case the turning device executes turning angle exceeding the set maximum value.

According to an embodiment, the alternating turning system includes an electric control device. The electric control device may be a computer including one or more processors for executing software program code. The execution of the software program may be configured to cause the alternating turning system to control the turning device to reverse direction of the turning movement repeatedly and to ensure that magnitude of the turning motion is always below an allowed maximum turning angle. The electronic control device may also receive measuring signals and data relating to realized turning movements generated by the turning device. Then the electronic control device may monitor the operation of the apparatus and may execute safety measures defined in the software program if undesired operation is detected. Thereby, the safe operation of the turning device may be controlled and monitored by means of software means.

According to an embodiment, the safe operation of the turning device is secured by utilizing two or more of the above disclosed embodiments. Thereby the limited turning movement of the drilling tool may be ensured by using several safety arrangements, physical means, electrical devices and control principles.

According to an embodiment, the apparatus may prevent the operation of the turning device in case the safety system detects any abnormality in the system. This way any abuse by operators is prevented and it is not possible to take off the safety system and disable monitoring. The apparatus may include a self-checking feature for determining the operational state and safety of the system.

According to an embodiment, the turning device is an electrical turning actuator. Then the alternating turning system includes at least one electrical control element for controlling electric current directed to the electrical turning actuator, whereby the turning direction of the turning actuator is reversed in response to operation of the control element. The safety system of the apparatus may be configured to monitor operational condition of the alternating turning system and its control element. Alternatively, or in addition to, the safety system may monitor realized turning angle of the drilling tool and may terminate the tuning if the detected turning angle exceeds a predetermined maximum turning angle limit. Further, the rock drilling machine, the shank or the drilling tool may be equipped with mechanical stoppers for preventing full revolution of the drilling tool.

According to an embodiment, the apparatus and system may have a restricted operating mode, which differs from the normal drilling mode. The restricted operating mode may be selected for duration of coupling drill rods together when the drilling is a so called extension rod drilling, for example.

The restricted operation mode may allow the drilling tool to be rotated one or more full revolutions but rotational speed is limited to be very low, whereby the slowly rotating parts do not cause danger. When the restricted operating mode is connected the operator may be informed by using warning signals and indicators.

According to an embodiment, the safety system is configured to produce a detection signal for an operator of the apparatus in response to the detected malfunction of operation of the alternating turning system and/or of the detected malfunction of the safety system, and the caused instant stoppage of the rotation, whereby the operator becomes informed of the operating condition of the apparatus. Thus, the apparatus includes one or more indicators.

According to an embodiment, the disclosed solution is implemented in percussion drilling, such as top-hammer drilling or DTH-drilling.

According to an embodiment, the disclosed solution is implemented in rotary drilling.

The embodiments disclosed above may be implemented in the disclosed apparatus as well as in the disclosed rock drilling rig and method. Thereby, the embodiments above, and dependent apparatus claims, comprise suitable additional features, which may be used as additional steps and procedures for amending also the independent method claim of this patent application.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the disclosed solution in a simplified manner. In the figures, like reference numerals identify like elements.

DETAILED DESCRIPTION

Figure 1:
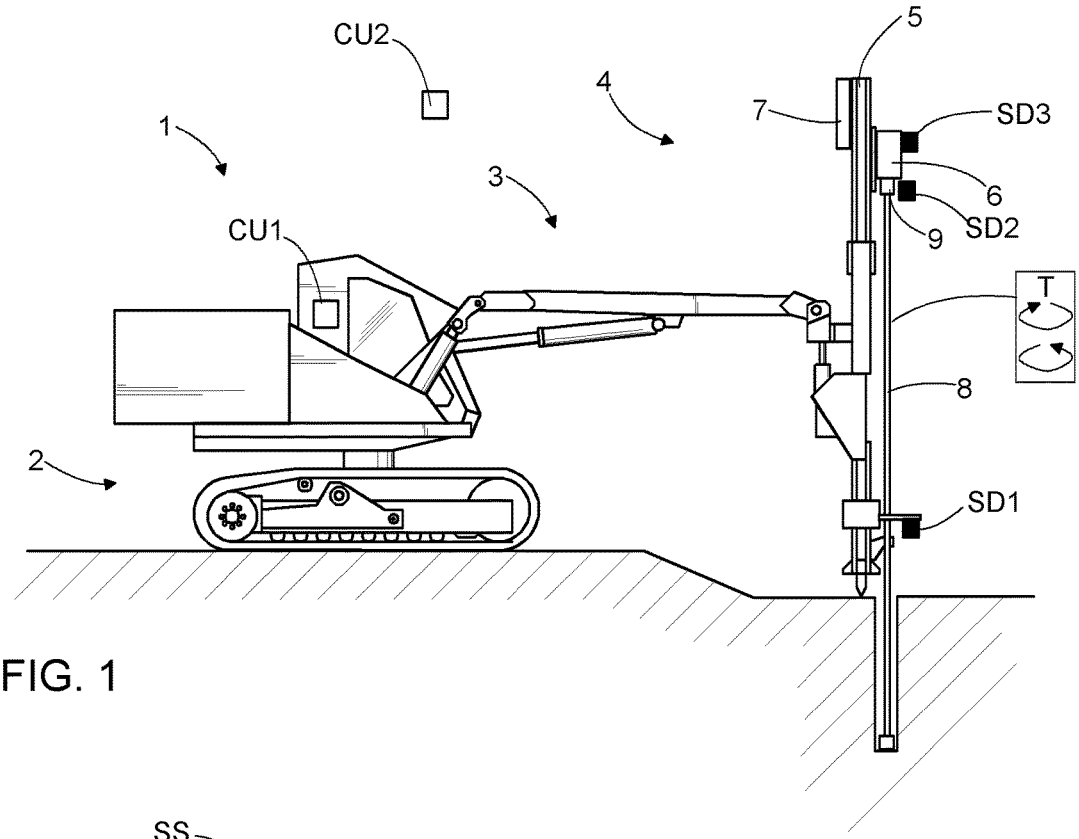
FIG. 1 is a schematic side view of a rock drilling rig for surface work sites and arranged to implement the disclosed apparatus and method.

FIG. 1 shows a rock drilling rig 1 including a movable carrier 2, one or more drilling booms 3 and drilling units 4 arranged in the drilling booms 3. The drilling unit 4 includes a feed beam 5 on which a rock drilling machine 6 can be moved by means of a feed device 7. Further, the drilling unit 4 includes a drilling tool 8 with which impact pulses generated by an impact device of the rock drilling machine 6 are transmitted to the rock to be drilled. The rock drilling machine 6 is also provided with a turning device for moving the drilling tool 8 around longitudinal axis of the drilling tool during the drilling. The turning device is controlled to reverse direction of movement of the drilling tool repeatedly, as it is indicated by arrows and a reference numeral T. In some drilling techniques the drilling may be executed without providing the drilling tool with impact pulses, whereby the drilling machine 6 is then without any impact device.

The rock drilling rig 1 may include one or more control units CU1, which may be configured to control an alternating turning system for providing the repeatedly reversing turning motion T for the drilling tool 8. Alternatively, the alternating turning system may be a pressure medium or electrically controlled control valve arranged to control a pressure fluid operated turning device. Thus, the alternating turning movement may be controlled under a control of a software program and other electrical control means, or by means of hydraulic or pneumatic control means.

The on-board control unit CU1 may also be configured to operate as a part of a safety system, which safety system is configured to secure that magnitude of the realized turning movements T is always below an allowed predetermined value. Then, the control unit CU1 may be provided with a safety software program. The drilling unit 4 may be provided with one or more sensing devices SD1-SD3 for monitoring the realized turning movements of the tool 8, a shank 9 or inner elements of the rock drilling machine 6, for example. Produced sensing data of the sensing devices SD may be transmitted to the control unit CU1 and may be processed therein. In case the safety system detects that the turning movement exceeds set maximum limit values, then the operation of the drilling machine 6 is stopped.

Alternatively, the safety system may include a control unit CU2 or a suitable electrical device of its own. The dedicated control unit CU2 may be located on the carrier, or it may be a device external to the rock drilling rig 1. The dedicated control unit CU2 may communicate with the control unit CU1 of the rock drilling rig for receiving sensing data and transmitting control data for triggering an emergency stop. Thus, the alternating turning system and the safety system may be controlled by means of the main control unit CU1 of the rock drilling rig, or alternatively the systems may have one shared control unit or one or more dedicated control units of their own. Further, herein the term "control unit" may refer to any one of the control units and corresponding electrical control devices suitable for processing the sensing data and executing the defined actions.

As can be noted in FIG. 1, there is no need to use protection cages around the drilling tool 8 and the rock drilling machine 6 because the disclosed alternating turning system generates repeatedly reversing turning movement for the drilling tool 8 instead of continuous rotation, and because the safety system secures proper operation of the apparatus. Due to this, visibility to the drilling position is good and the drilling unit has smaller outer dimensions and weight.

Figure 2:
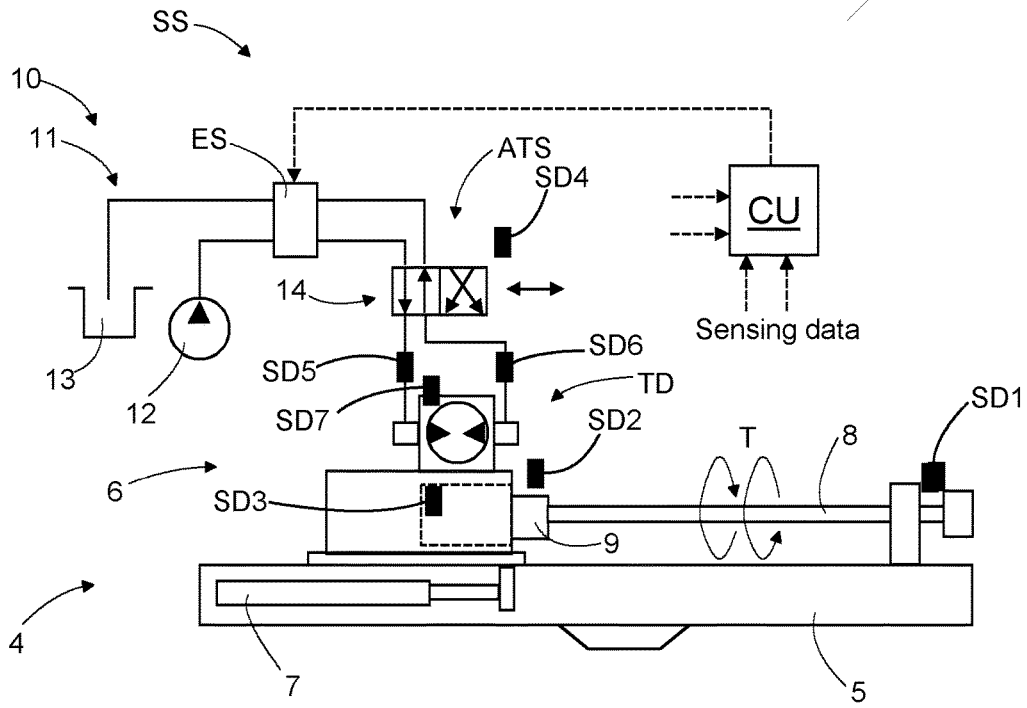
FIG. 2 is a schematic side view of a rock drilling unit provided with a turning device and an alternating turning system for producing repeatedly reversing turning movements.

FIG. 2 discloses a rock drilling unit 4 having a rock drilling machine 6, which is provided with a hydraulically operated turning device TD and an alternating turning system ATS for controlling the turning device TD. The rock drilling unit 4 further includes a safety system SS for securing the operation of the rock drilling machine 6. The turning device TD may be a hydraulic motor 15 connected to a hydraulic system 10 having pressure medium ducts 11 or fluid ducts, a pressure source 12 and a tank 13. The alternating turning system ATS may comprise a control valve 14 connected to the hydraulic system 10 and being arranged to change direction of pressure medium in pressure ports of the hydraulic motor 15. The control valve 14 may be controlled by means of a control unit CU of the rock drilling rig, for example. The control valve 14 may move linearly between at least two control positions, as it is indicated by means of an arrow in FIG. 2, or in an alternative construction the valve may turn between the control positions. When the control valve 14 changes its control position repeatedly, the turning device TD generates reversing turning motion. In other words, the control valve 14 continuously changes the turning direction of the turning device TD and a drilling tool 8.

The safety system SS may include one or more movement or position sensing devices SD4 for detecting proper movement or position of the control valve 14. Thus, the sensing device SD4 may monitor working cycle of the control valve 14. Alternatively, or in addition to, pressure or flow sensing devices SD5 and SD6 may be arranged to pressure ports of the hydraulic motor, or to pressure ducts controlled by the control valve 14.

By means of the sensing devices SD5 and SD6 properties and variations of hydraulic fluid in the controlled pressure lines may be detected and proper operation may be determined based on the sensed data. Further, one or more sensing devices SD7 may be arranged to monitor realized turning movement of the hydraulic motor 15, or properties of pressurized fluid inside the hydraulic motor 15. It is also possible to monitor realized turning movements by means of sensing devices SD1-SD3 in a similar manner as in FIG. 1. The sensing device SD3 may be arranged to detect movement of a transmission element of the rock drilling machine 6, for example. Thus, the safety system SS may includes one or more sensing devices SD and there are several alternative ways to monitor proper operation of the rock drilling machine and the alternating turning system ATS.

The sensing data generated by the one or more sensing devices SD1-SD7 may be transmitted to the control unit CU of the safety system SS. The control unit CU determines whether the turning device TD and the alternating turning system ATS operates properly, and if defects are noted, the system controls one or more emergency stops ES for stopping the operation of the turning device TD. In FIG. 2 the emergency stop ES may comprise at least one valve configured to prevent pressure medium to flow in the pressure medium ducts 11 when being actuated.

Figure 3:
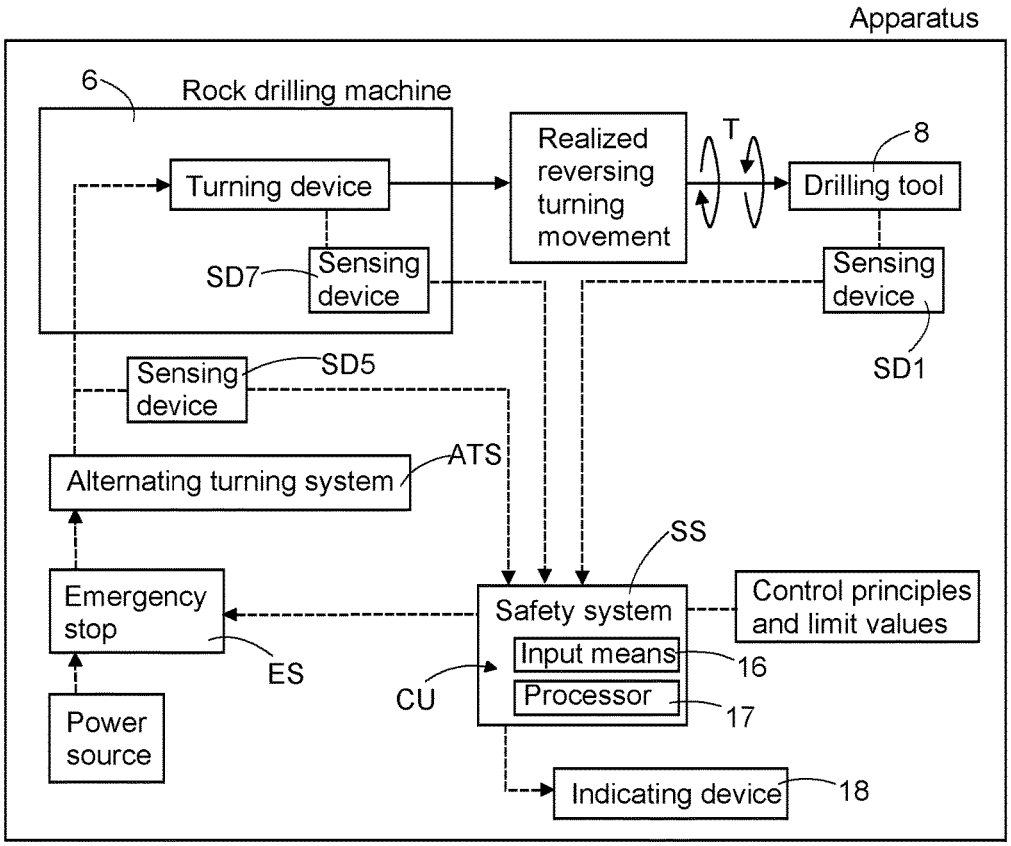
FIG. 3 is a schematic diagram presenting elements and features of the disclosed apparatus and examples of gathering sensing data for a safety system.

FIG. 3 is a schematic diagram presenting the already disclosed features of FIGS. 1 and 2 in a more general concept. The safety system SS may include a control unit CU or electrical control device of its own whereby it may be an independent device relative to the control unit of the rock drilling rig. The safety system SS includes input means 16 for feeding sensing data, software programs, control principles and turning angle limit values, for example. The safety system also includes one or more processors 17 for executing input software programs, for making needed calculations and for producing control commands. An operator of the rock drilling rig may be provided with needed information by means of a display device, indicator lamp or corresponding indicating device 18, whereby the operator is aware of the operational status of the disclosed apparatus. The safety system SS may actuate an emergency stop ES for preventing transmitting operating power to the turning device TD. When the turning device is fluid operated the emergency stop ES may be a valve, and when the turning device is electrically operated, the emergency stop may be an electrical switch, for example.

Figure 4:
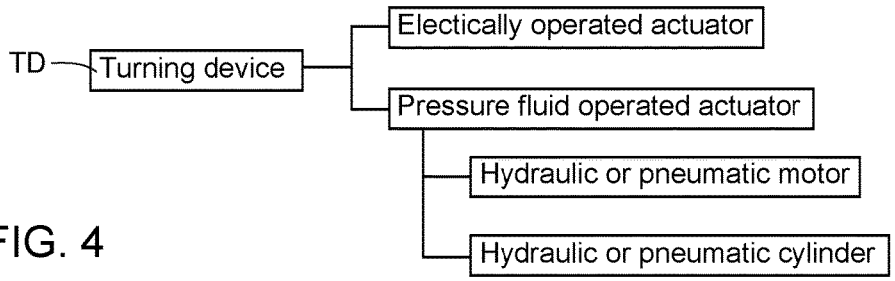
FIG. 4 is a schematic diagram presenting alternative turning devices suitable to be used for turning a drilling tool in accordance with the disclosed solution.

FIG. 4 is a schematic diagram presenting some alternative turning devices TD suitable to be used for turning a drilling tool in accordance with the disclosed solution. The turning device TD may be an electrically operated motor or actuator, or alternatively, it may be a pressure fluid operated actuator such as hydraulic or pneumatic motor or cylinder.

Figure 5:
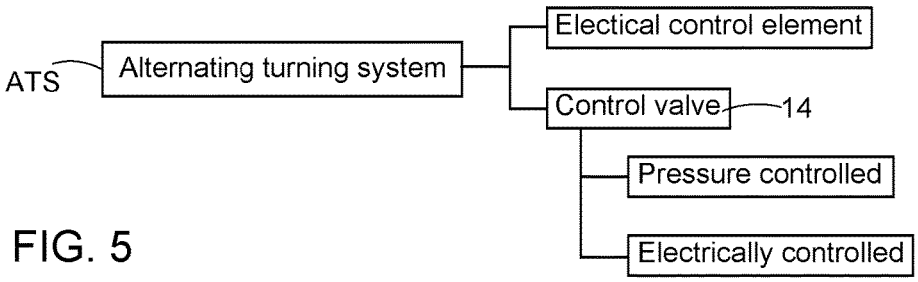
FIG. 5 is a schematic diagram presenting alternative embodiments of an alternating turning system and its control means.

FIG. 5 is a schematic diagram presenting alternative embodiments of an alternating turning system. The alternating turning system ATS may have an electrical control element, which may control operation of an electrical turning device. The electrical control element may be a switch, for example, and may be controlled by a software program executed in a control unit. Alternatively, the alternating turning system ATS may comprise a hydraulic or pneumatic control valve 14, which is configured to control pressure medium flows. The control valve 14 may be pressure controlled or electrically controlled in order move the valve between control positions.

Figure 6:
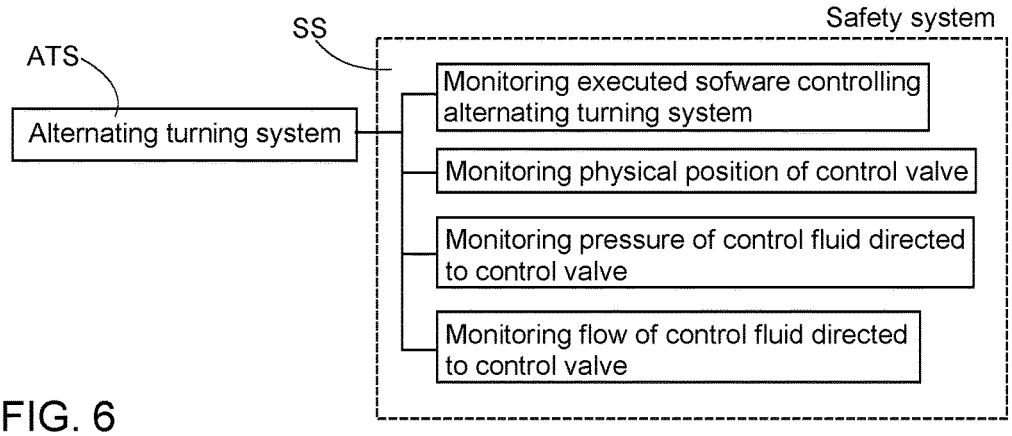
FIG. 6 is a schematic diagram presenting alternative ways for a safety system to monitor operation of an alternating turning system.

FIG. 6 is a schematic diagram presenting alternative ways for a safety system to monitor operation of an alternating turning system. As it is disclosed already above, the safety system may include sensing devices for detecting physical position of a control valve and/or sensing devices for monitoring prevailing pressures and flows of control fluid directed to a fluid operated control valve of the alternating turning system. Further, the monitoring may be executed without sensing devices when the alternating turning system is controlled by a software program executed in a control unit of the alternating turning system. Then, the safety system may monitor the execution of the software program and the operation of the control unit.

Figure 7:
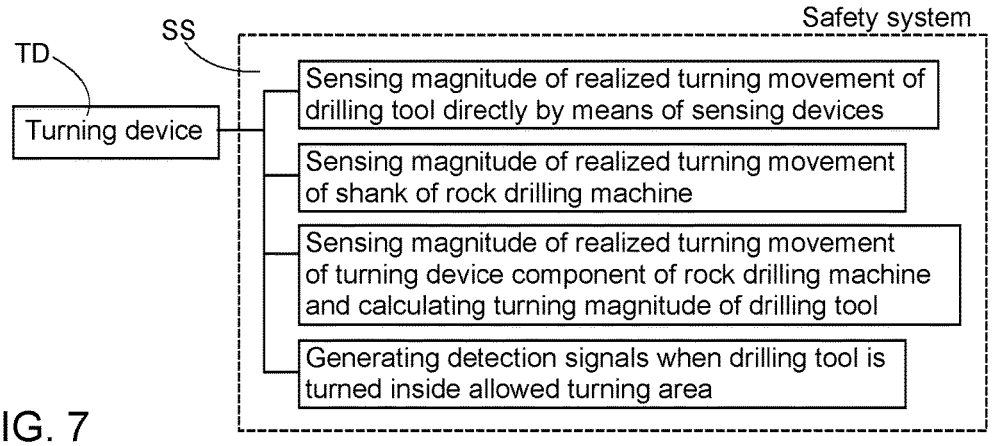
FIG. 7 is a schematic diagram presenting ways for a safety system to monitor realized alternating turning movements generated by a turning device.

FIG. 7 is a schematic diagram presenting some feasible ways for a safety system to monitor realized alternating turning motion generated by a turning device. As it is disclosed in connection with the previous figures, the safety system may includes one or more sensing devices for sensing magnitude of the realized turning movement of a drilling tool, a shank and/or a turning device machine or transmission component. A further alternative is to generate and receive detection signals when the drilling tool or any other component turned by means of the turning device is being turned inside an allowed predetermined turning area. This solution is disclosed in more detailed in connection with FIGS. 12*a*-12*d*.

Figure 8:
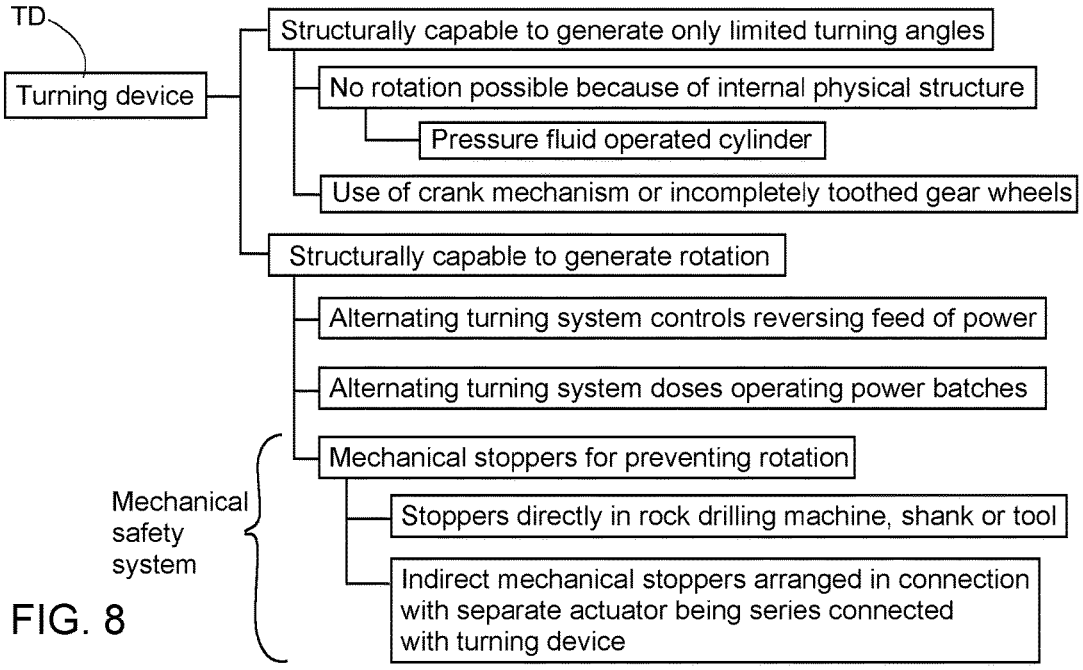
FIG. 8 is a schematic diagram presenting features relating to structural differences of different type of turning devices, and their structural capability to generate rotation.

FIG. 8 is a schematic diagram presenting in a general way some features relating to structural differences of different type of possible turning devices. The rock drilling machine may be provided with a turning device an internal structure of which only allows generating limited turning angles without rotation. The turning device may also be provided with transmission means, which are capable to transmit only movements with limited turning movements. Thus, the turning device may be itself safe regarding the rotation. However, in case the turning device is structurally capable to generate rotation, the limited turning movement may be executed by controlling, by means of the alternating turning system, the turning device to only perform limited movements. Alternatively, or in addition to, mechanical stoppers may be utilized for limiting the turning movements. The mechanical stopper may be considered to operate as a mechanical safety system alone or together with an electrical safety systems provided with electrical sensing, processing and actuation means.

Figure 9:
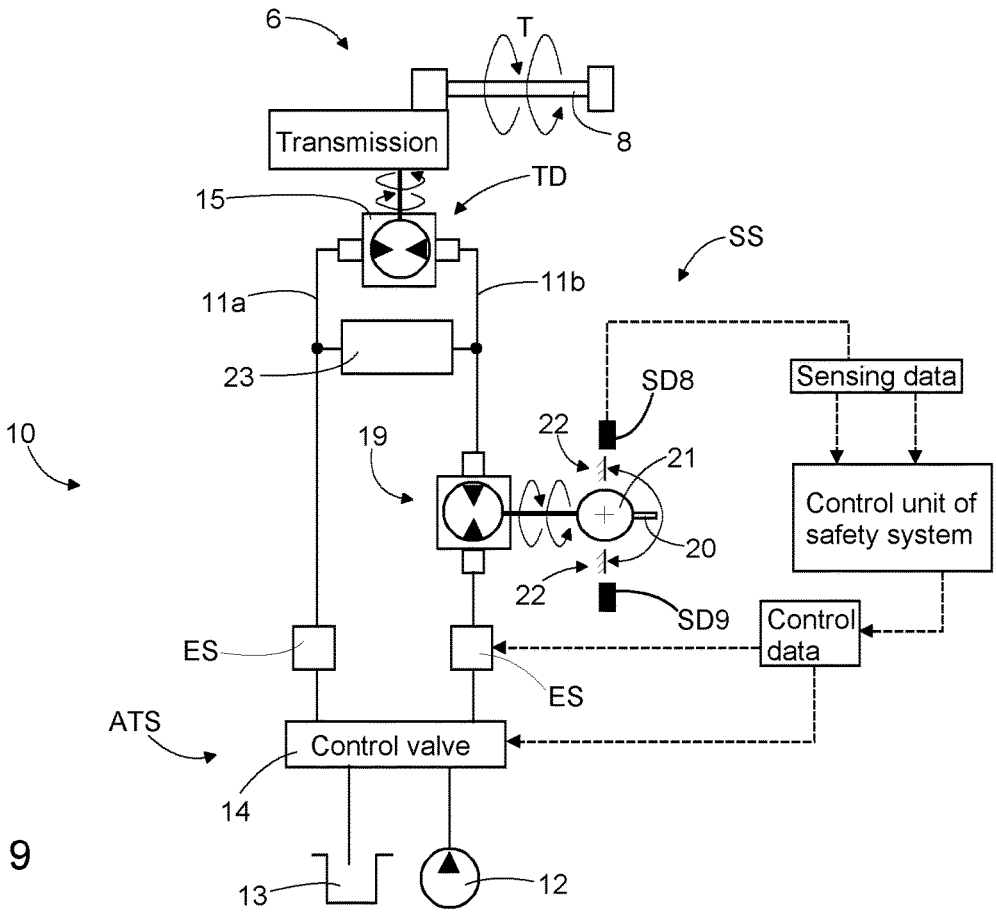
FIG. 9 shows schematically a hydraulic circuit provided with a rock drilling machine comprising a main hydraulic motor serving as a turning device, and wherein a safety system includes an additional second hydraulic motor being series-connected with the main hydraulic motor.

FIG. 9 discloses a hydraulic rock drilling machine 6 connected to a hydraulic circuit 10 having fluid ducts 11*a* and 11*b*, pressure medium source 12 and a tank 13. A turning device TD of the rock drilling machine 6 is a first hydraulic motor 15 connected to the fluid ducts 11*a* and 11*b*. An alternating turning system ATS includes a control valve 14 for controlling direction of pressure medium flows in the fluid ducts 11*a* and 11*b*. A safety system SS includes an additional second hydraulic motor 19 connected to the fluid duct 11*b*. The second hydraulic motor 19 is series-connected with the first hydraulic motor 15, whereby both hydraulic motors 15, 19 operate simultaneously. Hydraulic volume of the second hydraulic motor 19 may be set according to hydraulic volume of the first hydraulic motor 15 and transmission means of the rock drilling machine, whereby turning movements of the second hydraulic motor 19 and the drilling tool 8 have the same magnitude.

A magnitude of the realized turning movements of the second hydraulic motor 19 may be limited by a mechanical stopper 20, which may be arranged on a turning element 21, such as an axle. Around the turning element 21 may be stopping surfaces 22, or corresponding mating elements, for limiting the turning motion of the stopper 20. Thus, the disclosed mechanical stopper system stops the second hydraulic motor 19 at the extreme positions of the movement range set by the stopping surfaces 22, where after no hydraulic fluid flows through the second hydraulic motor 19. Thereby, the fluid duct 11*b* is blocked and the first hydraulic motor 15 is also stopped. It can be considered that the second hydraulic motor 19 doses hydraulic fluid batches though it and thereby have effect on the first hydraulic motor 15 in both turning directions. By means of the control valve 14 direction of fluid flow in the hydraulic circuit 10 and operating direction of the hydraulic motors 15, 19 may be reversed. Between the fluid ducts 11*a*, 11*b* may be an anticavitation element 23 for preventing cavitation of the hydraulic pumps 15, 19 by allowing in special situations fluid flow through the cavitation element 23.

Further, in connection with the stopping surfaces 22 may be limit switches or sensing devices SD8, SD9 for sensing the approaching stopper 20 already before it contacts against the stopping surfaces 22. Produced sensing data is communicated to a control unit CU of the safety system SS, which may generate control data for controlling the control valve 14 of the alternating turning system ATS. Thus, the disclosed system in connection with the second hydraulic motor 19 may be utilized to produce control data for the control valve 14, whereby during normal operation no mechanical stopping occurs. Instead, the second hydraulic motor 19 is stopped hydraulically. The second hydraulic motor 19 may serve as a turning dosing mechanism for allowing batches of fluid to flow in the hydraulic system 10. The control valve 14 changes the direction of the flow in the hydraulic circuit 10 repeatedly. In other words, the stopper 20 is used to monitor the realized turning movements and the monitoring data is utilized for controlling the alternating turning system ATS. In case the alternating turning system ATS or electrical components of the safety system SS fail, then the mechanical stopping means 20, 22 of the safety system SS prevent oversized turning movements. Further, the safety system SS may also comprise emergency switches ES, such as emergency valves, for shutting the fluid ducts 11*a*, 11*b* in case of detected failures in the safety system SS.

Figure 10A:
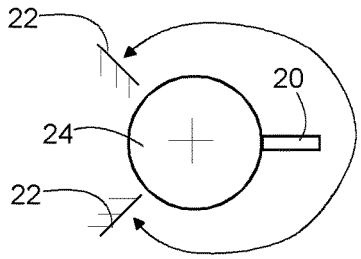
FIGS. 10*a* to 10*d* show schematically, alternative safety systems for securing that magnitude of the generated turning movement is always limited.

FIGS. 10*a* to 10*d* disclose alternative safety systems for securing that the turning movement generated by a turning device is limited. In FIG. 10*a* a turning element 24 is provided with a mechanical stopping system having a stopper 20 on the turning element 24 and stopping surfaces 22 around the turning element. The turning element 24 may be a drilling tool, shank, or a machine component of the rock drilling machine or transmission system. A further possibility is to arrange an auxiliary component provided with the mechanical stopping system between the rock drilling machine and the drilling tool.

Figure 10B:
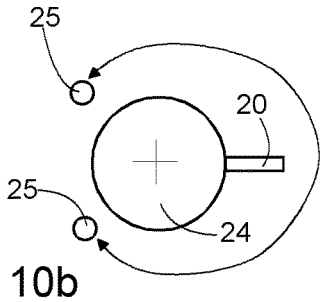
Figure 10C:
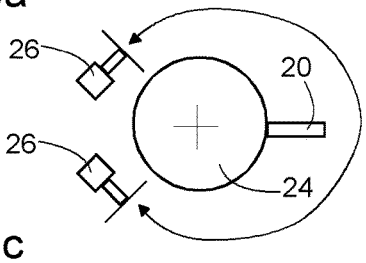
Figure 10D:
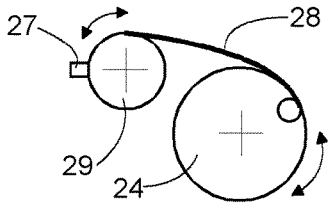

The arrangement of FIG. 10*b* differs from the one shown in FIG. 10*a* in that the stopping surfaces 22 are substituted by safety wires 25. When the stopper 20 meets the safety wire 25, this can be sensed by a switch or sensing device and the safety system may stop the turning device. Further, in FIG. 10*c* the safety wires of FIG. 10*b* are substituted by limit switches 26, which are actuated by the stopper 20 in case of exceed of set maximum turning angle value. In FIG. 10*d* it is disclosed a so called yo-yo-type safety device comprising a special switch 27, which is connected to the turning element 24 by means of a bendable wire 28 or strip of a rotatable reel 29. As the turning element 24 is turned by the turning device, the bendable wire 28 tightens and causes force effect for the switch 27. Exceeding of the limited turning movements are arranged to cause the switch 27 to be triggered and the operation of the turning device is then stopped. The length of the wire 28 is dimensioned so that the desired limited turning movement is allowed without causing the switch 27 to be triggered.

Figure 11:
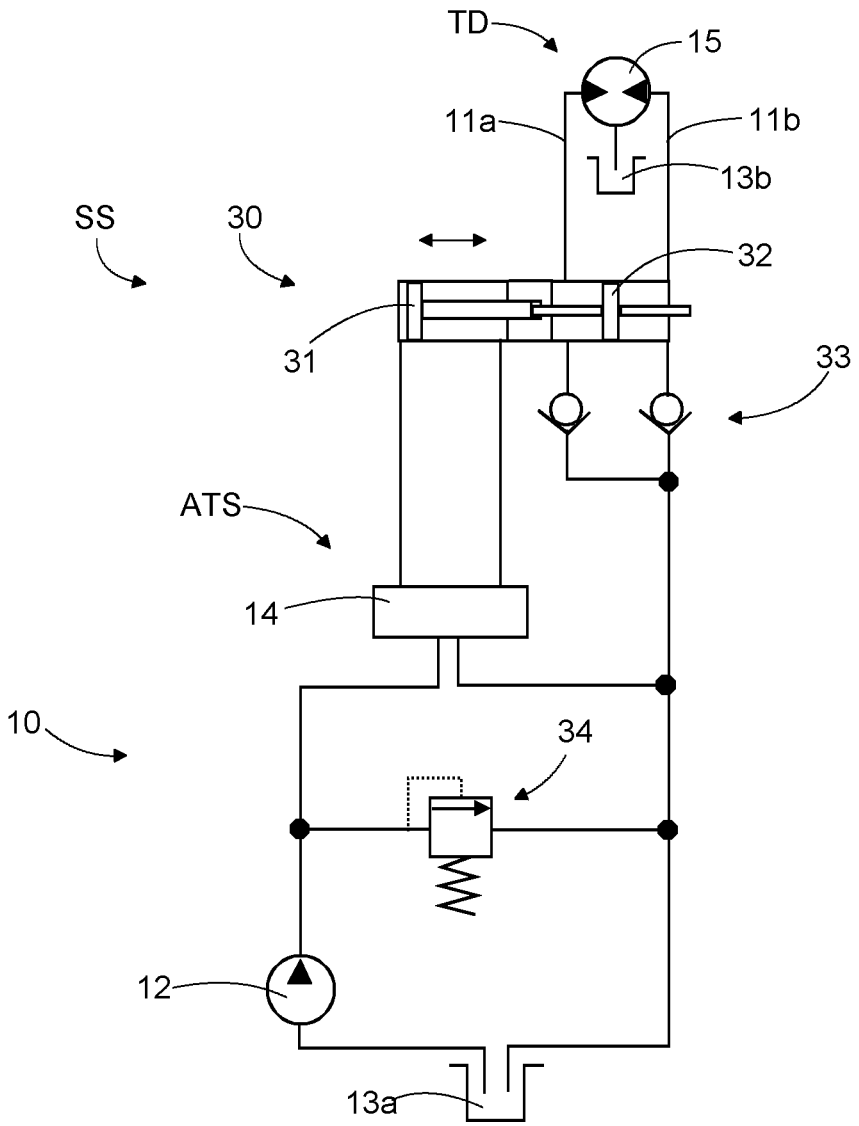
FIG. 11 shows schematically a hydraulic circuit provided with a dosing cylinder mechanism for providing a turning device with dosed pressure fluid batches causing alternating turning movements in both turning directions.

FIG. 11 discloses a hydraulic circuit 10 provided with a dosing cylinder mechanism 30 for providing a turning device TD with dosed pressure fluid batches causing alternative turning movement in both turning directions. The dosing cylinder mechanism 30 includes a working cylinder 31 and a dosing cylinder 32 connected to move together. The working cylinder 31 is controlled by means of a control valve 14 of an alternating turning system ATS to execute reciprocating working cycle. Each stroke of the working cylinder 31 causes the dosing cylinder 32 to dose limited volume of pressurized fluid to a hydraulic motor 15 serving as a turning device TD. The dosed batches of pressurized fluid may allow only limited turning movements to be generated by means of the turning device. Thus, the dosing cylinder mechanism 30 serves as a hydraulic safety system SS.

In FIG. 11 valve means 33, such as one-way valves, allow pressure fluid to be fed on both cylinder spaces of the dosing cylinder 29 so that pressure in the system is maintained. Leakage flows of the hydraulic motor 15 may be directed to a tank 13*b*. The hydraulic circuit 10 may also include a pressure relief valve 34 for allowing by-pass flow when pressure in the hydraulic system exceeds a set magnitude.

Figure 12A:
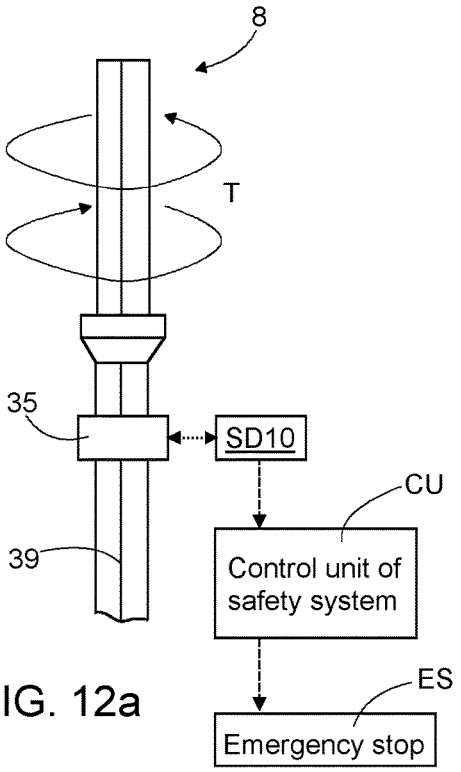
FIGS. 12*a*-12*d* show schematically a safety arrangement wherein a drilling tool is provided with a monitoring band comprising remote readable markers, which are located at a sensing area and are configured to generate detection signals when the drilling tool operates properly at the desired turning range.
Figure 12B:
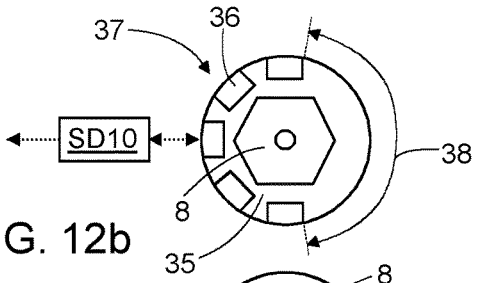
Figure 12C:
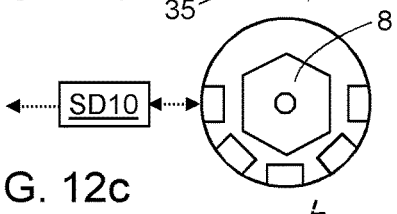
Figure 12D:
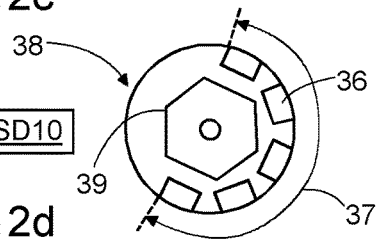

FIGS. 12*a*-12*d* disclose a safety arrangement wherein a drilling tool 8 is provided with a monitoring band 35 comprising remote readable markers 36, which are located at a sensing area 37 and are configured to generate detection signals when the drilling tool 8 operates properly at the desired turning range. Safety system SS includes a sensing device SD10 for detecting the markers 36 of the monitoring band 35. In FIGS. 12*b* and 12*d* the markers 36 of the sensing area 37 move together with the drilling tool 8 the alternating predetermined angular turning movement and detection signal is generated. In case the turning of the drilling tool 8 exceeds the allowed turning angle, then a non-sensing area 38 with no markers 36 becomes at the sensing device SD10 and then no detection signal is generated. This is disclosed in FIG. 12*d*. In other words, exceed of the allowed turning angle terminates generation of detection signals. Information of the missing detection signal is transmitted to a control unit CU of the safety system SS, which may actuate an emergency stop ES for stopping the turning.

An alternative solution for the use of the monitoring band 35 is that the sensing device SD10 detects edges 39 or other surface properties or shapes of the drilling tool 8 and the control unit CU determines the turning movements on the basis of that data.

Figure 13:
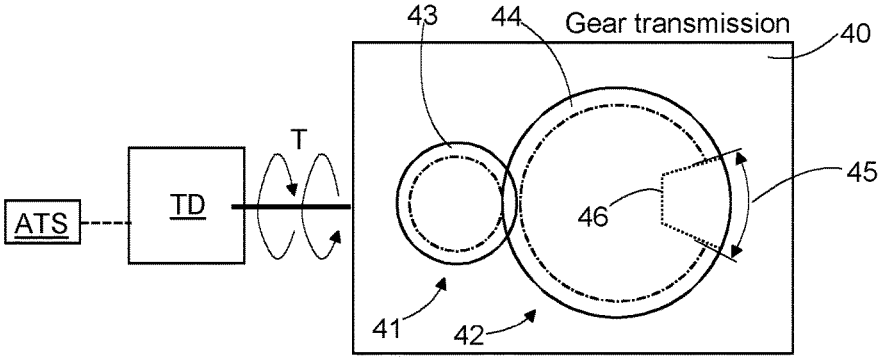
FIG. 13 shows schematically a mechanical safety arrangement wherein a gear transmission is provided with an incomplete gear tooth system, whereby the transmission is not capable to transmit rotation to a drilling tool.

FIG. 13 shows schematically an additional safety system SS wherein a gear transmission 40 is provided with an incomplete gear tooth system, whereby the transmission 40 is not capable to transmit rotation to a drilling tool in any situation. A turning device TD is controlled by means of an alternating turning system ATS to generate repeated limited turning movements, which are transmitted via the gear transmission 40 forwards. If the alternating turning system ATS fails, then the transmission 40 prevents mechanically oversized turning movements. The transmission may have a first gear wheel 41 and a second gear wheel 42, which both have toothed gear surfaces 43 and 44. The second gear wheel 42 includes a non-operational area or section 45, which is without proper teeth. The non-operational area 45 may comprise an open space 46, such as a cutting or cavity, incompletely manufactured gear teeth or a solid outer surface without any teeth.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. An apparatus for rock drilling comprising:

a rock drilling machine and a longitudinal drilling tool connectable to the rock drilling machine, the rock drilling machine including a turning device for moving the drilling tool around a longitudinal axis of the drilling tool;

at least one alternating turning system for controlling the turning device to reverse direction of movement of the drilling tool repeatedly and thereby generating allowed predetermined turning movements in a first turning direction and correspondingly in a second turning direction; and at least one separate safety system configured to secure independently relative to the turning device a magnitude of realized turning movements that are always below the allowed predetermined turning movements.

2. The apparatus as claimed in claim 1, wherein the safety system is configured to monitor operation of the alternating turning system, the safety system being configured to stop operation of the turning device in response to detected deviation in the operation of the alternating turning system.

3. The apparatus as claimed in claim 2, wherein the turning device is a pressure medium operated turning actuator, the alternating turning system including at least one control valve for controlling pressure prevailing in pressure medium ports of the turning device, whereby the turning direction of the turning device is reversed in response to operation of the control valve, and wherein the safety system of the apparatus is configured to monitor operation of the control valve.

4. The apparatus as claimed in claim 3, wherein the safety system includes at least one electrical monitoring element arranged in connection with the control valve for monitoring operation of the control valve.

5. The apparatus as claimed in claim 1, wherein the turning device of the rock drilling machine is a pressure medium operated motor.

6. The apparatus as claimed in claim 1, wherein the turning device of the rock drilling machine is a hydraulic motor, the turning device being connected to a hydraulic circuit by at least one pressure medium duct, the alternating turning system including at least one control valve for controlling pressure medium flow in the mentioned pressure ducts, the safety system including at least one additional second hydraulic motor connected to the at least one pressure medium duct, whereby the second hydraulic motor is series-connected with the hydraulic turning device and a magnitude of the realized turning movements of the additional second hydraulic motor is mechanically limited, whereby the additional second hydraulic motor is configured to prevent the turning device from exceeding allowed predetermined turning movements.

7. The apparatus as claimed in claim 1, wherein the safety system includes at least one sensing device for detecting a turning angle of the produced turning movement, which is directed to the drilling tool, the safety system being provided with at least one maximum turning angle limit and the safety system being configured to stop the turning in response to detected exceed of the maximum turning angle limit.

8. The apparatus as claimed in claim 1, wherein the safety system includes at least one sensing device for detecting realized turning movement of the drilling tool or shank, the safety system being configured to calculate a magnitude of realized turning angle of the drilling tool on a basis of detection data, the safety system being provided with at least one maximum turning angle limit and the safety system is configured to stop operation of the turning device in response to detected exceed of the maximum turning angle limit, whereby the magnitude of the realized turning movement of the drilling tool is always below the allowed predetermined turning movements.

9. The apparatus as claimed in claim 1, wherein the safety system includes at least one sensing device mounted to the rock drilling machine for detecting realized turning movement of the turning device, the safety system being configured to calculate a magnitude of realized turning angle of the drilling tool on a basis of detection data of the rock drilling machine, the safety system being provided with at least one maximum turning angle limit and the safety system is configured to stop operation of the turning device in response to detected exceed of the maximum turning angle limit, whereby the magnitude of the realized turning movement of the drilling tool is always below the allowed predetermined turning movements.

10. The apparatus as claimed in claim 1, wherein the turning device of the rock drilling machine is a hydraulic motor, the turning device being connected to a hydraulic circuit by pressure ducts, the alternating turning system having at least one control valve, the safety system including at least one dosing cylinder mechanism connected to the pressure ducts of the hydraulic motor, wherein the control valve is configured to control reciprocating motion of the dosing cylinder mechanism, and each stroke of the dosing cylinder mechanism is configured to dose limited volume of hydraulic fluid to the hydraulic motor, whereby the dosed batches of hydraulic fluid are configured to generate limited turning movements for the hydraulic motor.

11. The apparatus in claim 1, wherein the turning device of the rock drilling machine is a pressure medium operated turning actuator connected to a pressure medium system by means of pressure medium lines, the safety system including at least one sensing device configured to sense properties of pressure medium in at least one pressure medium line connected to the pressure medium operated turning actuator and the safety system is configured to monitor the operation of the alternating turning system by means of the sensed data.

12. The apparatus as claimed in claim 11, wherein the safety system includes at least one flow sensing device arranged to detect pressure medium flow conveyed to the turning actuator and the safety system is configured to monitor the operation of the alternating turning system by means of the sensed flow data.

13. The apparatus as claimed in claim 11, wherein the safety system includes at least one pressure sensing device arranged to detect pressure in at least one pressure medium line of the turning actuator and the safety system is configured to monitor the operation of the alternating turning system by means of the sensed pressure data.

14. A rock drilling rig, comprising:

a movable carrier; and at least one drilling boom provided with at least one drilling unit having a rock drilling machine and a feed device for moving the rock drilling machine, the rock drilling machine including a turning device for moving a drilling tool around a longitudinal axis of the drilling tool, at least one alternating turning system for controlling the turning device to reverse direction of movement of the drilling tool repeatedly and thereby generating allowed predetermined turning movements in a first turning direction and correspondingly in a second turning direction, and at least one separate safety system configured to secure independently relative to the turning device a magnitude of realized turning movements that are always below the allowed predetermined turning movements.

15. A method for rock drilling, wherein drill hole is drilled by a rock drilling machine and a drilling tool connected to the rock drilling machine, the method comprising:

providing a rock drilling machine and a turning device to turn the drilling tool around a longitudinal axis of the drilling tool during the drilling in a turning movement;

reversing direction of the turning movement of the drilling tool repeatedly whereby the drilling tool is turned alternately in a first turning direction and correspondingly is a second turning direction; and securing by at least one separate safety system that is operationally independent relative to the turning device, a magnitude of realized turning movement in the first turning direction and the second turning direction that are always below allowed predetermined turning movements.

* * * * *